US006197080B1

(12) United States Patent
Rübenach

(10) Patent No.: US 6,197,080 B1
(45) Date of Patent: Mar. 6, 2001

(54) APPARATUS FOR SEPARATING FIBER MATERIAL FROM AN AIR STREAM

(75) Inventor: Bernhard Rübenach, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 09/253,054

(22) Filed: Feb. 19, 1999

(30) Foreign Application Priority Data

Feb. 19, 1998 (DE) ..... 198 06 891

(51) Int. Cl.[7] ..... B01D 29/62

(52) U.S. Cl. ..... 55/418; 19/105; 406/171; 406/172

(58) Field of Search ..... 55/337, 452, 455, 55/460, 459.1, 429, 461, 294, 418; 95/268; 209/250; 19/105; 406/171, 172

(56) References Cited

U.S. PATENT DOCUMENTS

| | | | | |
|---|---|---|---|---|
| 705,374 | * | 7/1902 | Benefield | 55/418 |
| 1,898,608 | * | 2/1933 | Alexander | 55/459.1 |
| 1,945,820 | * | 2/1934 | Mitchell | 55/461 |
| 2,076,988 | * | 4/1937 | Garrett | 55/459.1 |
| 2,166,925 | | 7/1939 | Mitchell et al. . | |
| 2,471,326 | * | 5/1949 | Hoyt, Sr. | 55/459.1 |
| 2,772,445 | * | 12/1956 | Hubbard | 406/171 |
| 2,929,112 | | 3/1960 | Massey et al. . | |
| 3,284,140 | | 11/1966 | Reiterer . | |
| 4,737,175 | * | 4/1988 | Rice | 55/418 |
| 4,900,345 | * | 2/1990 | Jeune | 55/337 |
| 5,257,831 | | 11/1993 | Garcia . | |
| 5,294,218 | * | 3/1994 | Fiorentini et al. | 55/429 |
| 5,641,339 | * | 6/1997 | Johnson | 95/268 |
| 5,800,578 | * | 9/1998 | Johnson | 95/268 |

FOREIGN PATENT DOCUMENTS

| | | |
|---|---|---|
| 1 096 808 | 1/1961 | (DE) . |
| 2 034 805 | 1/1972 | (DE) . |
| 28 34 586 | 2/1980 | (DE) . |
| 84 31 649 | 2/1985 | (DE) . |
| 0 810 309 | 12/1997 | (EP) . |
| 1115131 | 5/1968 | (GB) . |
| 1149368 | 4/1969 | (GB) . |
| 1452365 | 10/1976 | (GB) . |

* cited by examiner

*Primary Examiner*—David A. Simmons
*Assistant Examiner*—Robert A. Hopkins
(74) *Attorney, Agent, or Firm*—Venable; Gabor J. Kelemen

(57) ABSTRACT

An apparatus for separating fiber tufts from a fiber tuft-laden conveying air stream includes a generally vertically oriented feed chute having an upper portion and a lower portion; an air-pervious screen disposed in the upper chute portion; an inlet channel having an outlet opening in the upper portion for introducing the fiber tuft-laden conveying air stream into the upper portion and for directing the fiber tuft-laden conveying air stream toward the inner face of the screen for effecting an impingement of the fiber tufts on the screen and a passage of the air stream, stripped of the fiber tufts, through the screen; and a mechanism disposed in the upper chute portion adjacent the inner screen face for effecting a sweeping motion of the fiber tuft-laden conveying air stream back and forth over the inner screen face for removing a pressing force of the air stream on the fiber tufts against the inner face of the screen, whereby the fiber tufts fall off the inner screen face by gravity toward the lower chute portion.

6 Claims, 7 Drawing Sheets

APPARATUS FOR SEPARATING FIBER MATERIAL FROM AN AIR STREAM

CROSS REFERENCE TO RELATED APPLICATION

This application claims the priority of German Application No. 198 06 891.3 filed Feb. 19, 1998, which is incorporated herein by reference.

BACKGROUND OF THE INVENTION

This invention relates to an apparatus for separating fiber material from a conveying air stream and advancing the fiber material to a fiber processing machine. The apparatus includes a substantially vertical feed chute having an upper, fiber inlet portion provided with a pneumatic fiber supply device having a stationary, air pervious screen for separating the fiber material from the conveying air stream which, stripped of the fiber material, is guided away from the feed chute.

In a known apparatus of the above type the air pervious screen is a horizontally arranged, downwardly open, semi-cylindrical shell and the intake channel which delivers the fiber-laden air stream into the feed chute merges into the feed chute with a tangential orientation toward the screen. The intake channel is connected to a fiber conveying fan, and the open outlet of the semi-cylindrical shell merges in the inlet opening of the feed chute. The fiber-laden air stream is guided along the inner cylindrical wall face of the screen, and then the fiber material drops into the feed chute. In order to increase the impact effect and thus ameliorate the dust removal from the mixture of fiber tufts and air, the power of the air stream may be increased by suitably adjusting the output of the fiber conveying fan. Such a procedure, however, has the disadvantage that the powerful air stream causes the fiber tufts to adhere to the inside face of the screen and thus accumulate there, clogging the screen and interfering with a proper fiber flow into the feed chute.

SUMMARY OF THE INVENTION

It is an object of the invention to provide an improved apparatus of the above-outlined type, from which the discussed disadvantage is eliminated, and in which particularly the degree of cleaning of the fiber tufts and dust removal therefrom are significantly increased, and furthermore, operational disturbances are avoided.

This object and others to become apparent as the specification progresses, are accomplished by the invention, according to which, briefly stated, the apparatus for separating fiber tufts from a fiber tuft-laden conveying air stream includes a generally vertically oriented feed chute having an upper portion and a lower portion; an air-pervious screen disposed in the upper chute portion; an inlet channel having an outlet opening in the upper chute portion for introducing the fiber tuft-laden conveying air stream into the upper chute portion and for directing the fiber tuft-laden conveying air stream toward the inner face of the screen for effecting an impingement of the fiber tufts on the screen and a passage of the air stream, stripped of the fiber tufts, through the screen; and a mechanism disposed in the upper chute portion adjacent the inner screen face for effecting a sweeping motion of the fiber tuft-laden conveying air stream back and forth over the inner screen face for removing a pressing force of the air stream on the fiber tufts adhering against the inner face of the screen, whereby the fiber tufts fall off the inner screen face by gravity toward the lower chute portion.

Thus, the apparatus according to the invention effects a back-and-forth oscillation of the fiber-laden air stream over the inner surface of the air-previous screen in the upper portion of the feed chute. As a result, despite the powerful impacting of the fiber tufts on the screen, an accumulation of the fiber tufts on the inner screen surface is prevented; rather, after the fiber tufts hit the screen and particularly after the air stream moves laterally away therefrom as the sweeping effect continues, the fiber tufts fall off the screen by gravity and travel downward in the vertical feed chute.

DESCRIPTION OF THE PREFERRED EMBODIMENTS

Figure 1:
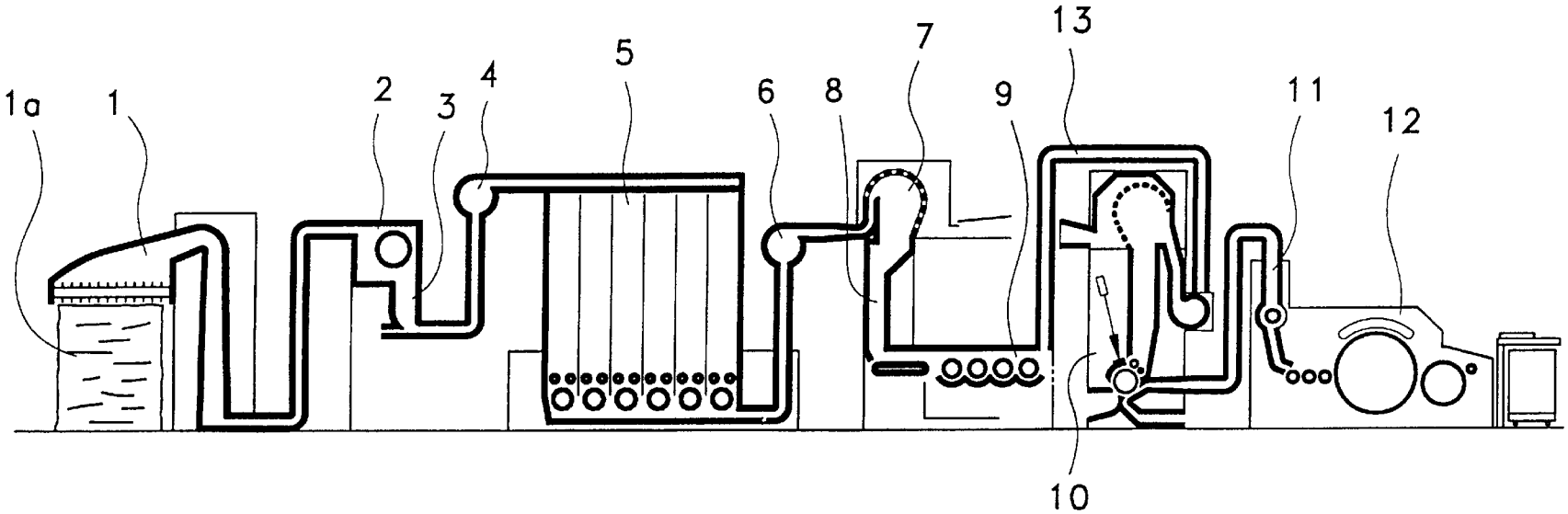
FIG. 1 is a schematic side elevational view of a fiber opening, cleaning and carding line incorporating the invention.

FIG. 1 illustrates a fiber processing line whose first machine is a bale opener 1 which may be a BLENDOMAT BDT model, manufactured by Trützschler GmbH & Co. KG, Mönchengladbach, Germany. Between the bale opener 1 and a fiber mixer 5 a high-capacity condenser 2 is arranged which is followed by a feed chute 3 and a fiber transporting fan 4. The mixer 5 is followed by a further fiber transporting fan 6, a fiber separator 7, a feeding device 8 and a multi-roll cleaner 9. The cleaner 9 is followed by the apparatus 10 according to the invention which, in turn, is adjoined in the downstream direction by at least one card feeder 11 and one carding machine 12 which may be, for example, an EXACTACARD DK model manufactured by Trützschler GmbH & Co. KG. Underneath the bale opener 1 a bale series la is positioned (only one bale is visible); the bale opener 1 travels over the bale series la in a direction perpendicular to the plane of drawing FIG. 1 while it removes fiber material from the top of the fiber bales. The above-described machines are serially connected by pneumatic conduits 13. It is noted that the directions "upstream" and "downstream" are related to the direction in which the fiber material travels through the fiber processing line.

Figure 2:
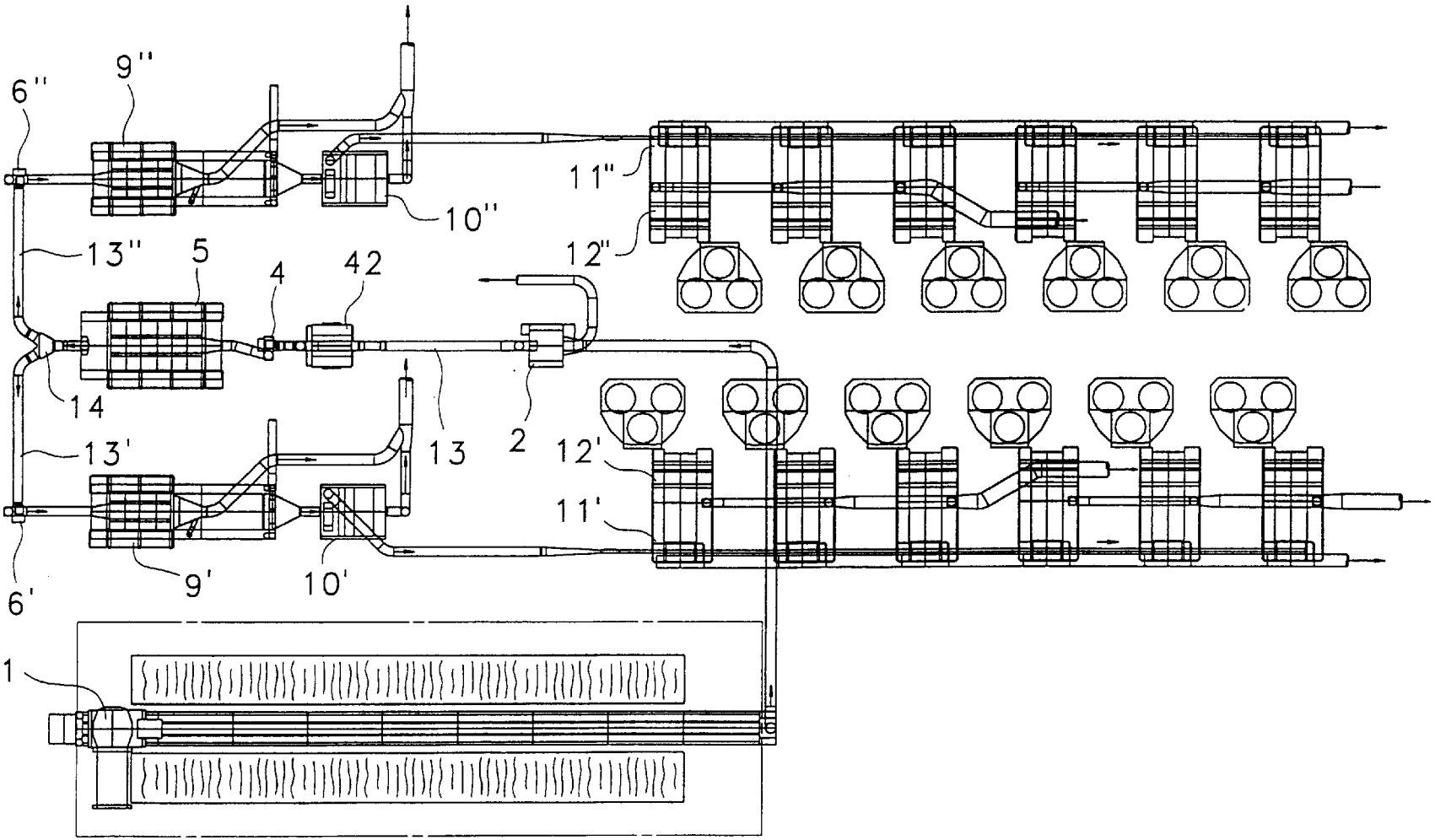
FIG. 2 is a schematic top plan view of a fiber processing line similar to FIG. 1 incorporating two apparatuses according to the invention.

Turning to FIG. 2, in the cotton cleaning line shown therein the mixer 5 is followed by a branch-off device 14 whose conduits 13', 13" lead to respective sawtooth cleaners 9', 9", each of which may be a CLEANOMAT CVT model, manufactured by Trützschler GmbH & Co. KG. Downstream of each sawtooth cleaner 9', 9" respective apparatuses 10' and 10" structured according to the invention are connected which, in turn, are followed by card feeders 11', 11" and associated carding machines 12', 12". Upstream of the mixer 5 a dual-roll cleaner 42 is positioned which may be an AXIFLO model manufactured by Trützschler GmbH & Co. KG.

Figure 3:
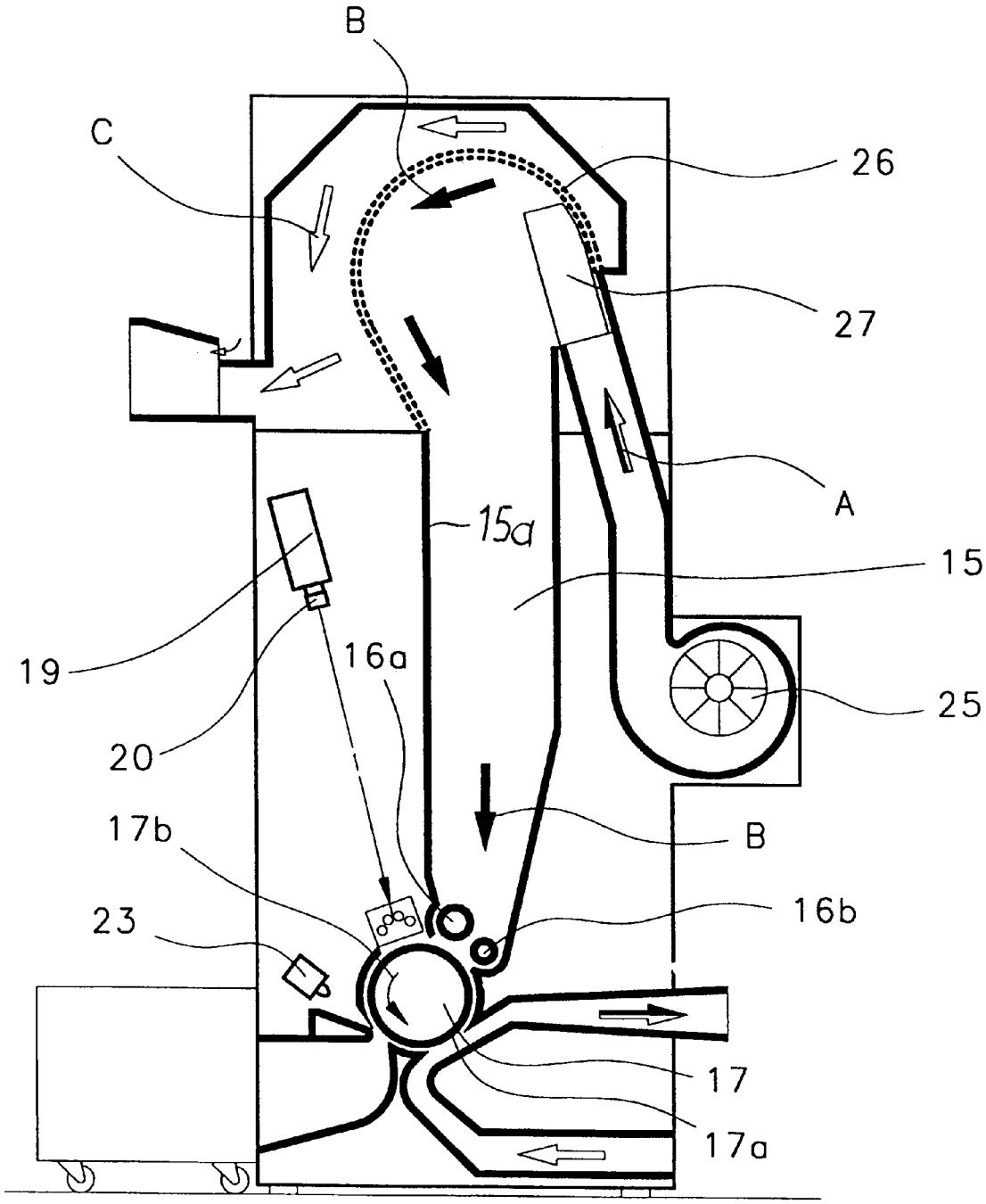
FIG. 3 is a schematic sectional side elevational view of a preferred embodiment of the invention including a feed chute and an after-connected opening roll as well as foreign material recognition and removal devices.
Figure 4:
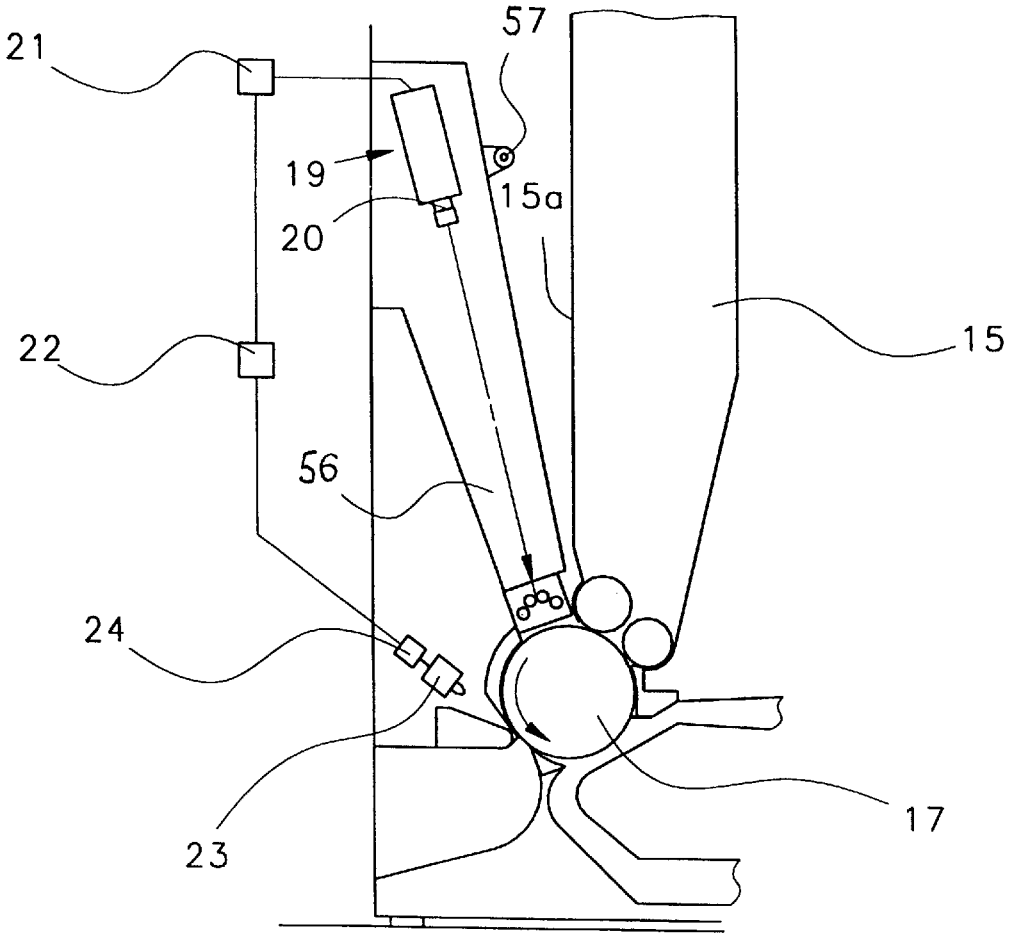
FIG. 4 is a schematic sectional side elevational view of an optical sensor system forming part of the invention and including a camera disposed adjacent a feed chute and oriented toward the opening roll.
Figure 5:
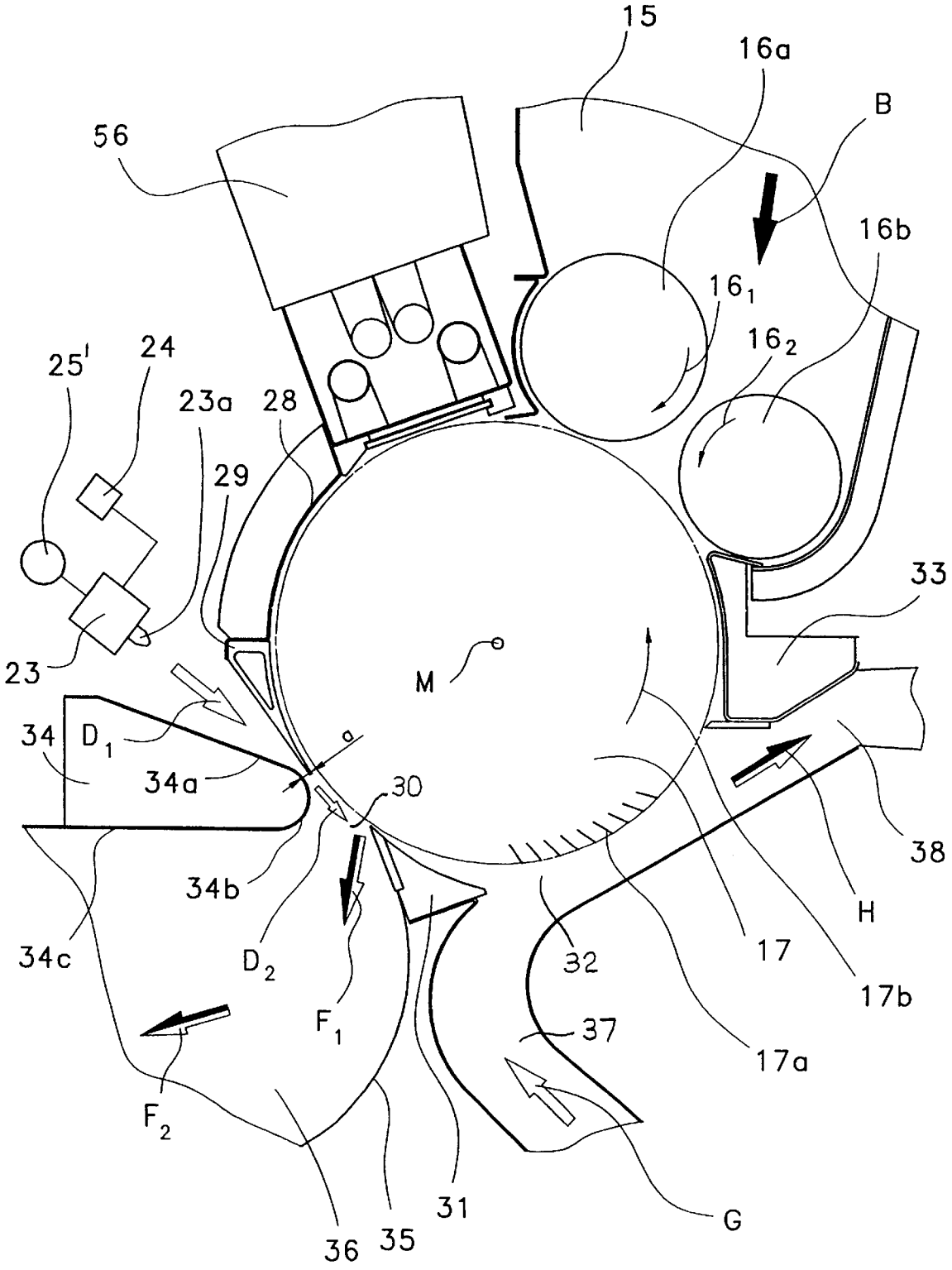
FIG. 5 is a schematic sectional elevational view of a device generating an air blast tangentially to an opening roll and having means for removing the air stream carrying foreign material.

Turning to FIGS. 3, 4 and 5, a substantially vertical tuft feed chute 15 has, at its lower end, two slowly rotating feed rolls (withdrawing rolls) 16*a* and 16*b* which introduce fiber material to a rapidly rotating opening roll 17 having a clothing 17*a* and a direction of rotation 17*b*. The withdrawing rolls 16*a*, 16*b* which rotate in the direction $\mathbf{16}_1$ and $\mathbf{16}_2$, respectively, are situated in the immediate vicinity of the clothing 17*a* of the opening roll 17. A camera 20, such as a CCD line camera of an optical sensor system 19 which also includes an electronic evaluating device 21 for recognizing foreign bodies, is directed to the clothing 17*a* of the opening roll 17. The sensor system 19 recognizes foreign bodies and particles, particularly those which deviate in lightness and color from the fiber material to be processed. The sensor system 19 is connected by means of an electronic control and regulating device 22 with a device 23 for removing the foreign bodies. The device 23 generates a short-duration, powerful air stream (air blast) oriented toward the clothing 17*a* for dislodging and carrying away foreign bodies with a small quantity of fibers from the clothing 17*a*.

A fiber transporting fan 25 pneumatically introduces fiber material into an upper inlet opening of the feed chute 15. A stationary, air-pervious surface (screen) 26 arranged at the top of the feed chute 15 separates the fiber material from the air stream which thus exits the feed chute 15, while the fiber material proceeds toward the withdrawing rolls 16*a*, 16*b*. Further in the upper part of the feed chute 15 an air stream guiding device 27 having movable elements is disposed for effecting a back-and-forth agitation of the fiber material at the inner face of the screen 26 as the air stream separates therefrom and passes through the screen 26. Eventually, the fiber material, substantially by gravity, drops down into the feed chute 15. The rolls 16*a*, 16*b* have a dual function: they serve as withdrawing rolls for the fiber material by pulling it downwardly in the feed chute 15 and also serve as feed rolls for presenting the fiber material to the opening roll 17.

The solid arrows in FIGS. 3, 5, 6, 7 and 7*a* illustrate fiber material flow, while the empty arrows indicate air streams without fibers and the half solid, half empty arrows designate fiber-laden air streams.

The camera 20 is situated, as shown in FIGS. 3 and 4, obliquely above the opening roll 17 in the vicinity of the outer wall 15*a* of the feed chute 17, whereby a compact, space-saving construction is obtained. The camera 20 is oriented towards the clothing 17*a* of the opening roll 17 and is capable of recognizing colored foreign material such as red fibers in the fiber flow. The range of the camera 20 includes the full axial length of the opening roll 17 which may be, for example, 1 m. As viewed in the direction of rotation 17*b* of the opening roll 17, downstream of the optical sensor system 19 the device 23 for generating a pneumatic stream is arranged which has a nozzle 23*a* oriented in the direction of the clothing 17*a* of the opening roll 17 in such a manner that a short-duration, powerful air stream flows to the clothing 17*a*, approximately tangentially thereto. The sensor system 19 is coupled via the evaluating device 21 and the electronic control-and-regulating device 22 with the air-blast generating device 23 which includes a valve control device 24. When the camera 20, based on comparison values or desired values, detects foreign material in the fiber mass situated on the clothing 17*a*, the valve control device 24 sends a command to the device 23 to emit a short, high-speed air blast toward the clothing 17*a* to remove the foreign material from the fiber layer on the clothing 17*a* with a small number of fibers.

Figure 4A:
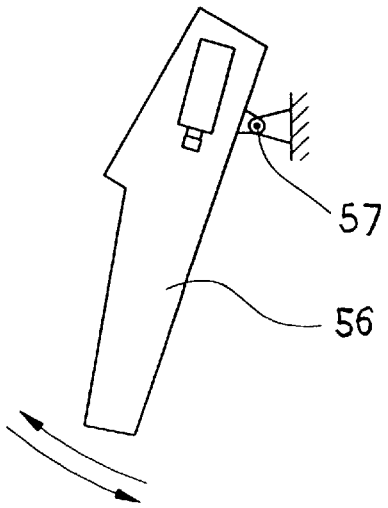
FIG. 4*a* is a schematic sectional side elevational view of the camera of FIG. 4, illustrated in a position pivoted away from the opening roll.

The sensor system 19 is accommodated in a housing 56 which, as shown in FIG. 4*a*, may be pivoted inwardly and outwardly about a stationary rotary support 57.

Turning to FIG. 5, the two withdrawing rolls 16*a* and 16*b* are arranged obliquely above the rotary axis M of the opening roll 17, adjacent the clothing 17*a* thereof. As viewed in the rotary direction 17*b*, downstream of the withdrawing rolls 16*a*, 16*b* a cover 28, a cover element 29, an opening 30, a cover element 31, an opening 32 and a cover element 33 are arranged in a circumferential series about the opening roll 17. The device 23 is coupled to a pressurized air source 25'. The valve control device 24 opens a non-illustrated valve of the separating device 23 for a short period so that a strong air jet $D_1$ with a high speed of, for example, 15–25 m/sec is discharged by the nozzle 23*a* of the separating device 23. Expediently, a non-illustrated nozzle bank with several linearly arranged nozzles 23*a* is provided which extends over the width (axial length) of the opening roll 17. The cover 29 and a guide face 34*a* of an oppositely situated guide element 34 are arranged conically with respect to one another and have, at their narrowest clearance, a distance a from one another through which the air stream $D_2$ passes in such a manner that it flows at a small distance from the clothing 17*a*. As a result, a suction stream $F_1$ is generated (based on the principle of a water jet pump) which, for a short period of time, locally tears away a small quantity of fibers together with the foreign material from the fiber layer carried on the clothing 17*a*. The guide element 34 has a rounded nose 34*b* and a further guide face 34*c* which, together with an oppositely disposed deflecting element 35, forms a channel 36 for guiding the air stream $F_2$ away from the opening roll 17. An air stream G flows in the direction of the opening roll 17 through a channel 37 toward the opening 32 for dislodging the fiber layer from the clothing 17*a* and flows through a channel 38 as a fiber-laden stream H.

Figure 6:
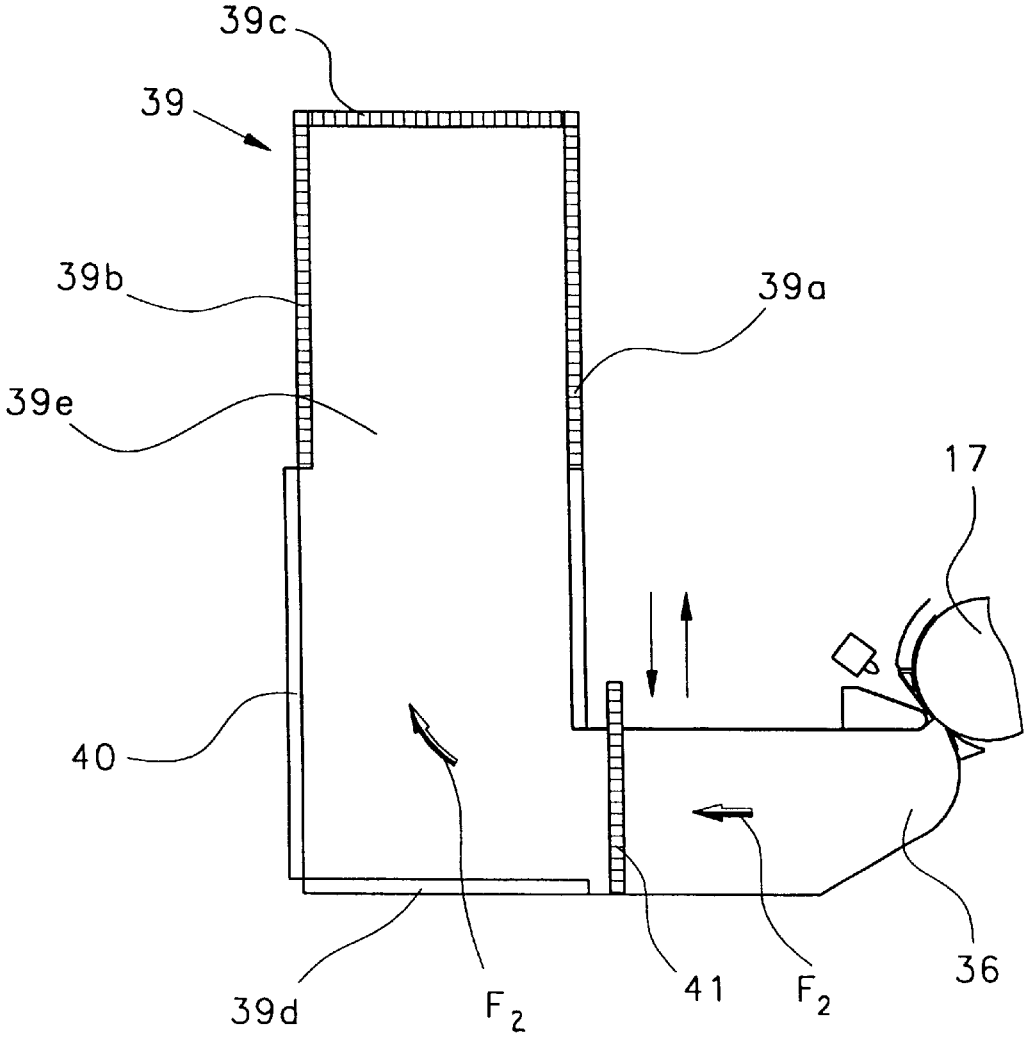
FIG. 6 is a schematic side elevational view of an air expansion and waste collecting chamber forming part of the invention.

Turning to FIG. 6, laterally of the feed chute 15 and the optical sensor system 19 a receptacle 39 is disposed, having a wall 39*a* provided with an opening connected to the channel 36. The fiber-laden air stream $F_2$ enters the inner chamber 39*e* of the receptacle 39. The volume of the chamber 39*e* is designed such that the air stream $F_2$ expands and its velocity significantly drops. The chamber 39*e* at the same time serves as a collecting space for the separated fiber material containing the foreign bodies. The side walls 39*a*, 39*b* and the top wall 39*c* of the receptacle 39 are formed as air-pervious screens to allow the air stream to be separated from the foreign material and to thus exit the receptacle 39.

Figure 6A:
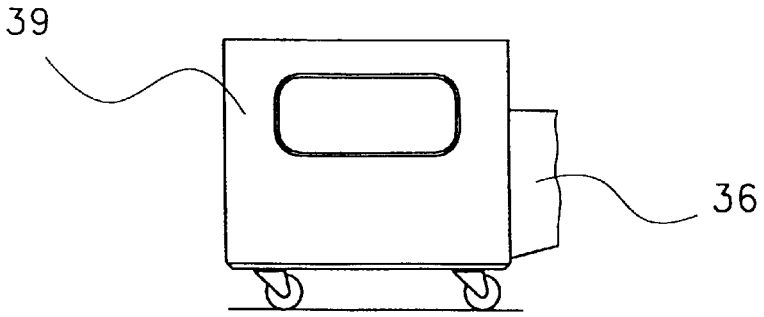
FIG. 6*a* is a schematic side elevational view of an air expansion and waste collecting chamber designed as a removable carriage.

In the plane of the side wall 39*b* an access door 40 is provided through which the waste collected in the chamber 39*e* may be periodically removed. Between the end of the channel 36 and the opening in the wall 39*a* an air-pervious slide 41 is provided which is displaceable in the direction of the two arrows when the access door 40 is opened or, respectively, closed. Preferably, the receptacle 39 is of upright design, whereby horizontal space may be saved. As shown in FIG. 6*a*, the receptacle 39 is part of a wheeled carriage which may be connected to or disconnected and moved away from the channel 36. The further wall faces of the receptacle 39 oriented perpendicularly to the walls 39*a*, 39*b* are not illustrated.

Figure 7:
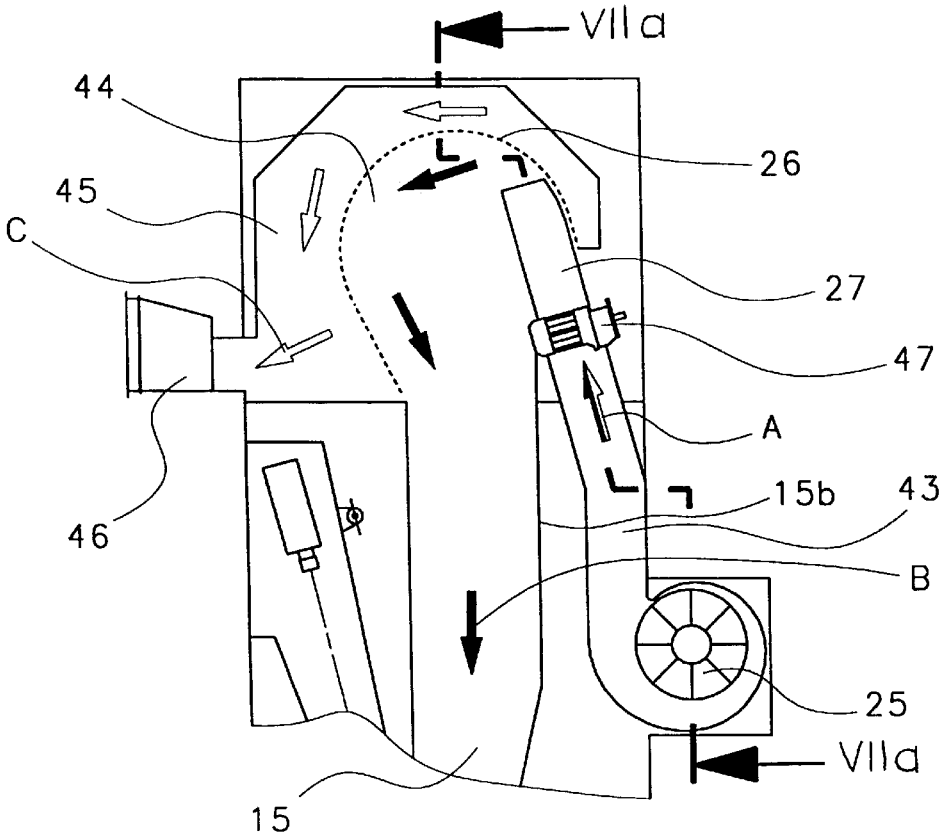
FIG. 7 is a schematic sectional side elevational view of a device for separating fiber material from the air stream.

As shown in FIG. 7, the fiber material transporting fan 25 is arranged laterally of the wall 15*b* of the feed chute 15. The fan 25 blows the fiber-laden air stream A (discharged, for example, by an upstream-arranged machine of the fiber processing line) through the conduit 43 into a chamber 44 in which the stationary, semi-cylindrical, air-pervious screen 26 is provided for separating the fiber material B from the air stream. The air stream C thus stripped of the fiber material (but still containing dust) passes through the screen 26 into the chamber 45 and exits through an outlet 46. The channel 43 is adjoined by an air guiding device 27 having movable elements (to be described in more detail below), whereby a reversible, back-and-forth guidance of the material in the air stream may be effected, and the fiber material B, after impinging on the air-pervious surface 26, drops downwardly essentially by gravity and is introduced into the feed chute 15. The outlet end of the conveying channel 43 merges into the chamber 44 approximately tangentially to the screen 26. During operation, the stream A, after impinging on the screen 26, sweeps therealong and thus has a cleaning effect thereon. The perforations (meshes) of the screen 26 have a size which is sufficient to allow passage of the dust-laden air stream C and small impurities on the fiber tufts but prevents passage of the fiber tufts B.

Figure 7A:
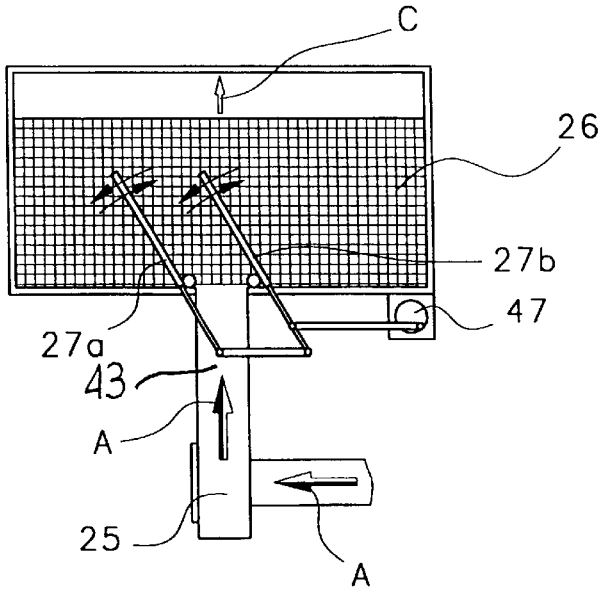
FIG. 7*a* is a sectional view taken along line VIIa—VIIa of FIG. 7.

Turning to FIG. 7*a*, the earlier-noted back-and-forth guidance of the fiber-laden air stream A is effected by a pair of oscillating, parallel-spaced air guiding members (guide plates) 27*a*, 27*b* driven, for example, by a motor 47. The outlet opening of the channel 43 is situated in the space between the two guide plates 27*a*, 27*b*. Expediently, the guide plate edges oriented toward the screen 26 are at such a distance therefrom that they do not drag the fiber tufts along the screen, once they adhere thereto. As the air stream, during its sweeping motion caused by the oscillating guide plates 27*a*, 27*b*, moves away from the fiber tufts adhering to the screen, the pressing force causing such an adherence is removed and, as a result, the fiber tufts fall off the screen by gravity toward the lower portion of the feed chute 15.

The invention also encompasses an embodiment in which the feed chute 15 serves as a fiber accumulator in a cleaning line such as shown in FIG. 1. Expediently, the feed chute 15 has a filling height regulating device including, for example, an optical barrier or the like, and further, the rpm of one or both withdrawing rolls 16*a*, 16*b* may be regulated. Preferably an electronic control-and-regulating device such as a microcomputer 22 is provided to which there are connected the setting member for the rpm of at least one of the feed rolls 16*a*, 16*b* and at least one measuring member sensing the fill level in the after-connected card feeder chutes 11 for the cards 12. Expediently, at the card feeders 11 electronic pressure switches are used as measuring members, and to the control-and-regulating device 22 an element is connected for determining a basic operating rpm as a function of the sum of all productions of the cards 12.

The invention also encompasses an embodiment in which the optical sensor system 19 is installed in a multi-roll cleaner 9 (FIG. 1) and is associated with a first opening roll, whereas the device 23 for generating the air blast is associated with the last opening roll, as viewed in the direction of fiber travel through the cleaner.

It will be understood that the above description of the present invention is susceptible to various modifications, changes and adaptations, and the same are intended to be comprehended within the meaning and range of equivalents of the appended claims.

What is claimed is:

1. An apparatus for separating fiber tufts from a fiber tuft-laden conveying air stream, comprising (a) a generally vertically oriented feed chute having an upper portion and a lower portion;

(b) an air-pervious screen disposed in said upper portion and having an inner face;

(c) an inlet channel having an outlet opening in said upper portion for introducing the fiber tuft-laden conveying air stream into said upper portion and for directing the fiber tuft-laden conveying air stream toward said inner face of the screen for effecting an impingement of the fiber tufts on said screen and a passage of the air stream, stripped of the fiber tufts, through said screen; and (d) a mechanism disposed in said upper portion of said feed chute adjacent said inner face of said screen for effecting a sweeping motion of the fiber tuft-laden conveying air stream back and forth over said inner face for removing a pressing force of the air stream on the fiber tufts against the inner face of the screen, whereby the fiber tufts fall off said inner face by gravity toward said lower portion of said feed chute.

2. The apparatus as defined in claim 1, wherein said inner face of said screen has a concave curvature.

3. The apparatus as defined in claim 1, wherein said outlet of said inlet channel is oriented tangentially to said inner face of said screen.

4. The apparatus as defined in claim 1, wherein said mechanism comprises (a) two parallel-spaced air guiding members disposed adjacent said inner face of said screen; and (b) a drive connected to said air guiding members for effecting an oscillating motion of said air guiding members over said inner face.

5. The apparatus as defined in claim 4, wherein said outlet of said inlet channel is disposed at all times between said two air guiding members.

6. The apparatus as defined in claim 1, wherein said screen divides said upper portion into inner and outer upper portions; further comprising a conduit extending from said outer upper portion for guiding away the air stream after passage thereof through said screen.

* * * * *